United States Patent [19]

Boettcher et al.

[11] Patent Number: 4,652,274

[45] Date of Patent: Mar. 24, 1987

[54] COATED ABRASIVE PRODUCT HAVING RADIATION CURABLE BINDER

[75] Inventors: Thomas E. Boettcher, Hastings; Victor P. Thalacker, Stillwater, both of Minn.

[73] Assignee: Minnesota Mining and Manufacturing Company, St. Paul, Minn.

[21] Appl. No.: 763,331

[22] Filed: Aug. 7, 1985

[51] Int. Cl.[4] ..... C09K 3/14

[52] U.S. Cl. ..... 51/298; 51/293; 51/295; 526/261

[58] Field of Search ..... 51/293, 295, 298; 526/261

[56] References Cited

U.S. PATENT DOCUMENTS

| | | | |
|---|---|---|---|
| 3,932,401 | 1/1976 | Berg et al. | 260/248 NS |
| 4,011,063 | 3/1977 | Johnston | 51/295 |
| 4,047,903 | 9/1977 | Hesse et al. | 51/298 |
| 4,126,428 | 11/1978 | Rude | 51/295 |
| 4,145,544 | 3/1979 | Kuehn | 544/222 |
| 4,240,807 | 12/1980 | Kronzer | 51/295 |
| 4,288,586 | 9/1981 | Bock et al. | 528/67 |
| 4,298,356 | 11/1981 | Teschner et al. | 51/295 |
| 4,324,879 | 4/1982 | Bock et al. | 528/45 |
| 4,345,545 | 8/1982 | Miller | 118/621 |
| 4,457,766 | 7/1984 | Caul | 51/298 |
| 4,485,226 | 11/1984 | Noll et al. | 528/45 |
| 4,547,204 | 10/1985 | Caul | 51/298 |

FOREIGN PATENT DOCUMENTS 2087263A 5/1982 United Kingdom .

*Primary Examiner*—Paul Lieberman
*Assistant Examiner*—Willie J. Thompson
*Attorney, Agent, or Firm*—Donald M. Sell; James A. Smith; David L. Weinstein

[57] ABSTRACT

A coated abrasive product comprising abrasive granules adherently bonded to at least one major surface of a backing sheet by a radiation curable resinous binder material. The binder material can be used to form the make coat, size coat, or both coats. Alternatively, the binder material can be used in embodiments where only a single binder coat is employed. The radiation curable resinous binder material comprises a copolymer formed from a mixture comprising (1) at least one monomer selected from the group consisting of isocyanurate derivatives having at least one terminal or pendant acrylate group and isocyanate derivatives having at least one terminal or pendant acrylate group, and (2) at least one aliphatic or cycloaliphatic monomer having at least one terminal or pendant acrylate group.

23 Claims, No Drawings

COATED ABRASIVE PRODUCT HAVING RADIATION CURABLE BINDER

BACKGROUND OF THE INVENTION

This invention relates to coated abrasive products having a resinous binder which holds and supports abrasive granules on a backing sheet.

Coated abrasives generally comprise a flexible backing upon which adhesive holds and supports a coating of abrasive granules. The backing may be paper, cloth, film, vulcanized fiber, etc. or a combination of one or more of these materials. The abrasive granules may be formed of flint, garnet, aluminum oxide, alumina-zirconia, diamond, silicon carbide, etc. Popular present day binders are phenolic resins, hide glue, and varnish. Phenolic resins include those of the phenol-aldehyde type. Besides phenolic resins, hide glue, and varnish, other known resinous binder materials employed in the preparation of coated abrasive products include epoxy resins, ureaformaldehyde resins, and polyurethane resins.

The coated abrasive may employ a "make" coat of resinous binder material which is utilized to secure the ends of the abrasive granules onto the sheet as the granules are oriented and a "size" coat of resinous binder material over the make coat which provides for firm adherent bonding of the abrasive granules to the sheet. The size coat resin may be of the same material as the make coat resin or of a different resinous material.

In the manufacture of coated abrasives, the make coat resinous binder and abrasive granules are first applied to the backing, then the size coat resinous binder is applied, and finally, the construction is fully cured. Generally, thermally curable binders provide coated abrasives having excellent properties, e.g. heat resistance. Thermally curable binders include phenolic resins, epoxy resins, and alkyd resins. With polyester or cellulose backings, however, curing temperatures are limited to about 130° C. At this temperature, cure times are long. The long cure times necessitate the use of festoon curing areas. Disadvantages of festoon curing areas include formation of defects at the suspension rods, inconsistent cure on account of temperature variations in the large festoon ovens, sagging of the binder, and shifting of abrasive granules. Furthermore festoon curing areas require large amounts of space and large amounts of energy.

It has been proposed to use radiation curing processes to avoid the disadvantages of thermal curing processes in the manufacture of coated abrasives. U.S. Pat. No. 4,047,903 discloses an epoxy-acrylic binder and electron irradiation to manufacture coated abrasives. U.S. Pat. Nos. 4,345,545, 4,457,766 and British Pat. No. 2,087,263A disclose a method for electron beam curing of resin coated webs in the manufacture of coated abrasives. Examples of electron beam curable resinous binders disclosed therein include urethane-acrylates and epoxy-acrylates. The binders disclosed in these patents are inferior to thermally curable binders with respect to thermal stability, surface hardness, and grinding performance.

SUMMARY OF THE INVENTION

This invention involves a coated abrasive comprising a backing bearing abrasive grains or granules in combination with a binder comprising a copolymer formed from (1) at least one monomer selected from the group consisting of isocyanurate derivatives having at least one terminal or pendant acrylate group and isocyanate derivatives having at least one terminal or pendant acrylate group, and (2) at least one aliphatic or cycloaliphatic monomer having at least one terminal or pendant acrylate group. The preferred monomers of the isocyanurate/isocyanate group have a heterocyclic ring configuration, the preferred monomer being the reaction product of a mixture of acrylic acid and methacrylic acid with tris(hydroxyalkyl)isocyanurate. The preferred aliphatic or cycloaliphatic monomer of the group having at least one acrylate group is trimethylolpropanetriacrylate. The copolymer is preferably formed by exposing a mixture containing the aforementioned monomers to conventional sources of electromagnetic radiation, preferably sources of ionizing radiation.

The performance of the coated abrasive of the present invention equals or exceeds that of coated abrasives formed with thermally curable phenolic resins, particularly with respect to grinding performance, hardness, and thermal stability. The coated abrasive of this invention demonstrates improved performance over radiation curable coated abrasives heretofore known, particularly with respect to thermal stability, surface hardness, and grinding performance.

DETAILED DESCRIPTION

The conventional components going to form the coated abrasive product of the invention will be selected from those typically used in this art. The backing, as previously mentioned, may be formed of paper, cloth, vulcanized fiber, polymeric film or any other backing material known for this use. The abrasive granules may be of any conventional grade utilized in the formation of coated abrasives and may be formed of flint, garnet, aluminum oxide, alumina:zirconia, diamond and silicon carbide, etc., or mixtures thereof. The frequency of the abrasive granules on the sheet will also be conventional. The abrasive granule may be oriented or may be applied to the backing without orientation, depending upon the requirements of the particular coated abrasive product.

The coated abrasive product of the invention may also include such modifications as are known in this art. For example, a back coating such as pressure-sensitive adhesive may be applied to the nonabrasive side of the backing and various supersizes, such as zinc stearate, may be applied to the abrasive surface to prevent abrasive loading, and others.

The binders for the coated abrasive of this invention comprise copolymers formed by the copolymerization of comonomers selected from two classes. The reaction mixture must contain at least one comonomer from each class. The first class of monomers includes isocyanurate derivatives or isocyanate derivatives having at least one terminal or pendant acrylate group. As used herein, "acrylate" includes both acrylate and methacrylate. The second class of aliphatic or cycloaliphatic monomers includes acrylic acid esters. These monomers must contain at least one terminal or pendant acrylate group.

The monomers of isocyanurate derivatives can be represented by the following structure:

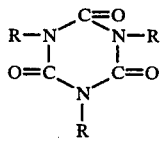

I where each R can be the same or different and represents a group containing at least one terminal acrylate or methacrylate group. Preferably, R represents

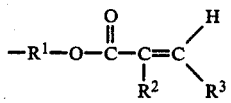

(Ia)

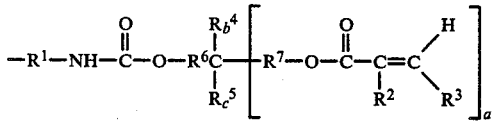

(Ib)

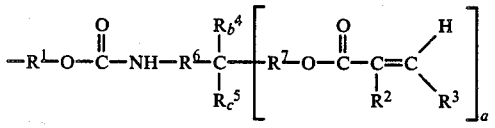

(Ic)

where $R^1$ represents a divalent alkylene group having, for example, from 1 to 20 carbon atoms, preferably from 1 to 10 carbon atoms, $R_2$ represents —H or —$CH_3$, $R^3$ represents —H or —$CH_3$, $R^4$ represents hydrogen, an alkyl group having, for example, 1 to 20 carbon atoms, an arylalkyl group having, for example, 6 to 26 carbon atoms, $R^5$ represents hydrogen, an alkyl group having, for example, 1 to 20 carbon atoms, an arylalkyl group having, for example, 6 to 26 carbon atoms, $R^6$ represents a divalent alkylene group having, for example, from 1 to 20 carbon atoms, preferably from 1 to 10 carbon atoms, $R^7$ represents a covalent bond or a divalent alkylene group having, for example, from 1 to 20 carbon atoms, preferably, 1 to 10 carbon atoms, a represents an integer from 1 to 3, inclusive, b represents 0 or 1, c represents 0 or 1, and a+b+c=3.

The moieties represented by $R^1$, $R^6$, $R^7$ can be straight chain, branched, or cyclic. If cyclic, the cyclic ring can contain 5 or 6 ring atoms.

Isocyanurate monomers suitable for the present invention can be prepared according to methods described in U.S. Pat. Nos. 3,932,401, 4,145,544, 4,288,586, 4,324,879, 4,485,226, all of which are incorporated herein by reference.

The monomers of acyclic isocyanate derivatives can be represented by the following structure:

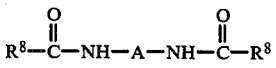

II where

A represents a divalent alkylene group having, for example, from 1 to 20 carbon atoms, preferably 1 to 10 carbon atoms, $R^8$ can be the same or different and represents

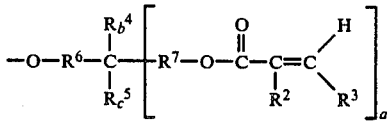

where a, b, c, $R^2$, $R^3$, $R^4$, $R^5$, $R^6$, $R^7$ are as defined above.

A can be straight chain, branched chain, or if sufficiently long, cyclic. Because of availability of starting materials, A is preferably $$-CH_2-C(CH_3)_2-CH_2-CH(CH_3)-CH_2-CH_2-.$$

The monomers in the heterocyclic ring configuration are preferred because polymers formed from them are more durable, particularly under high temperature grinding conditions.

The preferred aliphatic or cycloaliphatic monomers having at least one terminal or pendant acrylate group can be represented by the following structure:

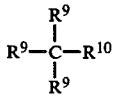

III where each $R^9$ can be the same or different, and $R^9$ represents H or

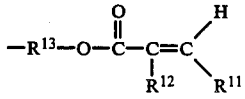

$R^{10}$ represents alkyl group having, for example, 1 to 10 carbon atoms, $R^{11}$ represents H or —$CH_3$, $R^{12}$ represents H or $CH_3$, $R^{13}$ represents a covalent bond or a divalent alkylene group having, for example, from 1 to 20 carbon atoms, provided that at least one $R^9$ is not H.

The moiety represented by $R^{13}$ can be straight chain, branched, or cyclic. If cyclic, the cyclic ring can contain 5 or 6 ring atoms.

Acrylate monomers of Formula III suitable for the present invention include the mono- or polyfunctional esters of acrylic, methacrylic, or crotonic acids, for example, methyl, ethyl, propyl, butyl, hexyl or hydroxyalkyl esters of these acids, and aromatic monomers such as vinyl toluene, styrenes, divinylbenzene and allylesters. Acrylic ester monomers suitable for this invention are commercially available.

The ratio of monomer I or monomer II to monomer III can range from about 1:3 to about 3:1, and preferably ranges from about 1.5:1 to about 1:1.5.

The copolymerizable monomers themselves can act as diluents to control the viscosity of the coating resin without imparting the pollution effects of non-reactive solvents.

In order to prepare the composition for preparing the binder, the monomers, along with any fillers, catalysts, and other additives are first mixed together in a suitable vessel. The thus-formed mixture is then applied to the surface upon which the coating is to be formed, e.g. the backing for the make coat, the layer of abrasive mineral for the size coat.

The copolymers useful in forming the binder of this invention are preferably formed and cured by means of electromagnetic radiation, more preferably ionizing radiation, e.g., electron beam radiation having an energy of 0.1 to 10 Mrad, preferably 1 to 10 Mrad. The amount of radiation used depends upon the degree of cure desired of the monomers used to prepare the copolymers. Typical electron radiation doses allow processing speeds of up to 300 m/min. The rate of curing with a given level of radiation varies according to the thickness as well as the density and nature of composition. Other sources of ionizing radiation suitable for curing the binders of this invention include gamma-radiation and X-ray. Ultraviolet radiation can also be used to form and cure the copolymers of the binder of this invention. In addition, after the binder is cured by means of radiation, it can be post-cured by means of thermal energy in order to fully cure any copolymer that may be in grit shadow during radiation exposure. Alternatively, the copolymers can be formed and cured by means of thermal energy. If thermal energy is employed, either for post-curing or for primary curing, it is preferable to include a thermal curing catalyst in the composition containing the monomers. Conventional peroxide curing catalysts, e.g. benzoyl peroxide, can be employed when thermal curing is utilized.

The make coat and the size coat can be cured simultaneously or separately. Cure can be performed in air, but is preferably performed in a nitrogen atmosphere. When cured separately, the make coat is cured in air because it is generally desired to have the surface of the make coat not fully cured at the time of the size coat application to allow the curing of the size coat to effect a bond between the two coats. Either the make coat or size coat can be thermally cured, typically with the addition of a proper catalyst. However, it is preferred that both make coat and size coat be radiation curable to retain the desired processing advantages.

It is not necessary that both the make coat and size coat be formed of the binder of the present invention. If the size coat is formed of the binder of this invention, the make coat can be formed of a conventional binder material, e.g. phenolic resins, hide glue, varnish, epoxy resins, urea-formaldehyde resins, polyurethane resins. If the make coat is formed of the binder of this invention, the size coat can be formed of a conventional binder material. Of course, both the make coat and size coat can be formed from a binder or binders of the present invention.

It is also contemplated that a single binder coat can be employed, rather than a make coat and a size coat. However, it is preferred that both a make coat and size coat be utilized.

The properties and performance of coated abrasives according to the invention are equal to or superior to those of coated abrasives having binders comprising phenolic resin. Properties such as Barcol hardness, temperature stability, binding strength, and durability under grinding conditions of the binders of this invention meet or exceed those properties exhibited by binders comprising phenolic resin. The cured resin of the abrasive products of this invention results in superior thermal resistance to binder degradation which is brought about by high speed grinding. Coated abrasive products employing the resinous binder of this invention are amenable to water cooling.

In addition, the binder of the present invention does not require a solvent, thereby eliminating the need for solvent removal and pollution abatement problems.

In the examples which follow, the following abbreviations are used:

AA—Acrylic acid
TMPTA—Trimethylol propane triacrylate
TATHEIC—Triacrylate of tris(hydroxy ethyl) isocyanurate
NVP—N-vinyl-2-pyrrolidone
HMDI—Tris(Hexamethylene diisocyanate)
HMDI-T7—Tris(Hexamethylene diisocyanate) having 7 acrylate groups
HMDI-T9—Tris(Hexamethylene diisocyanate) having 9 acrylate groups
N-BUMA—N-butyl urethane methacrylate
TEGDMA—Triethyleneglycol dimethacrylate
TMDI—2,2,4-trimethyl hexamethylene diisocyanate
TMDI-T2—2,2,4-trimethyl hexamethylene diisocyanate having 2 acrylate groups
TMDI-T4—2,2,4-trimethyl hexamethylene diisocyanate having 4 acrylate groups
IBOA—isobornyl acrylate
$CaCO_3$—calcium carbonate.

The following examples are offered to aid in understanding the present invention and are not to be construed as limiting the scope thereof. All amounts are in parts by weight unless indicated otherwise.

EXAMPLE 1

This example demonstrates how the superior surface hardness of the resins or copolymers used to prepare binders of this invention compares with that property of resins used to prepare binders of the prior art. In each sample, the binder was prepared by introducing the ingredients into a vessel equipped with a mechanical stirrer and stirring the ingredients until the mixture was homogeneous. The radiation-curable binder compositions were knife coated onto a polyethylene terephthalate (PET) film at a 4 mil wet thickness and then irradiated at 200 Kev with a dose of 5 Mrad in a nitrogen atmosphere with a Model 250 Electrocurtain® electron beam from Energy Science, Inc., Woburn, Mass. The phenolic control samples were prepared by casting the phenolic compositions in a glass tray, followed by a 90 minute cure at 90° C. and a subsequent 12 hour cure at 100° C.

The samples prepared as described above were measured for hardness by the Barcol method (ASTM D-2583-75). The method involves applying a force to a needle point, observing the penetration weight, and recording said weight as a percent of the weight required to penetrate glass. The results are shown in Table I, wherein samples 1 and 2 describe binders of the present invention and samples 3 through 8, inclusive, describe binders of the prior art. Samples 3–5 were thermally cured, and samples 6–8 were cured by radiation.

TABLE I

| Sample | Monomer A | Amount | Monomer B | Amount | Monomer C | Amount | Monomer D | Amount | Filler | Amount | Barcol hardness (%) |
|---|---|---|---|---|---|---|---|---|---|---|---|
| 1 | TMPTA | 50 | TATHEIC | 50 | — | — | — | — | — | — | 65–70 |
| 2 | TMPTA | 25 | TATHEIC | 25 | — | — | — | — | $CaCO_3$ | 50 | 60–65 |
| 3 | Phenolic | 100 | — | — | — | — | — | — | — | — | 40–45 |
| 4 | Phenolic | 100 | — | — | — | — | — | — | — | — | 45–50 |
| 5 | Phenolic | 50 | — | — | — | — | — | — | $CaCO_3$ | 50 | 50–55 |
| 6 | Acrylated-epoxy[1] | 30 | IBOA | 9 | NVP | 9 | TMPTA | 6 | $CaCO_3$ | 46 | 35–40 |
| 7 | Acrylated-epoxy[1] | 30 | IBOA | 9 | NVP | 0 | TMPTA | 6 | — | — | 35–40 |
| 8 | Acrylated-urethane[2] | 40 | NVP | 40 | TMPTA | 20 | — | — | — | — | 45–50 |

[1]Diacrylate ester of a bisphenol A type epoxy resin (Celrad ® 3600, Celanese Chemical Co.)
[2]Uvithane ® 893, Thiokol Corporation.

The filled and unfilled TMPTA/TATHEIC resin systems display hardness exceeding that of any of the other radiation-cured resins or of the thermally cured phenolic resins.

EXAMPLE 2

This example compares thermal stability of the radiation cured resinous binders of this invention with the thermally cured phenolic binders of the prior art. Thermal stability was measured by loss of weight, in percent, as a function of temperature.

Samples were prepared according to the procedure described in Example 1. The samples were removed from the PET film and glass tray and were analyzed by thermal gravimetric analysis (TGA). The TGA measurements were conducted in an air atmosphere at a flow rate of 100 cc/minute to a maximum temperature of 450° C. on a Perkin-Elmer Model TGS-2 thermal analyzer. The starting temperature of 20° C. was increased at a rate of 20° C./min. The results are shown in Table II, wherein samples 9 through 11, inclusive, describe the cured binder of the present invention, and samples 12 through 16, inclusive, describe binders of the prior art. Samples 12–14 were thermally cured and Samples 15–16 were cured by radiation.

TABLE II

| Sample | First monomer | Amount | Second monomer | Amount | Filler | Amount | Weight Loss (%) 100° C. | 200° C. | 300° C. | 400° C. | 450° C. |
|---|---|---|---|---|---|---|---|---|---|---|---|
| 9 | TMPTA | 50 | TATHEIC | 50 | None | — | 0.5 | 0.5 | 1.0 | 9.0 | 38 |
| 10 | TMPTA | 25 | TATHEIC | 25 | $CaCO_3$ | 50 | 0 | 0 | 0.5 | 3.5 | 45 |
| 11 | TMPTA | 25 | TATHEIC | 25 | Quartz | 50 | 0 | 0.5 | 1.0 | 3.5 | 17 |
| 12 | Phenolic | 100 | None | — | None | — | 1 | 4.8 | 10 | 18.4 | 47 |
| 13 | Phenolic | 100 | None | — | None | — | 2.75 | 6 | 8.5 | 17.5 | 40 |
| 14 | Phenolic | 50 | None | — | $CaCO_3$ | 50 | 1 | 3.5 | 5.5 | 19.5 | 43 |
| 15 | Acrylated-urethane[1] | 100 | None | — | None | — | 0 | 0 | 5.5 | 70 | 89 |
| 16 | Acrylated-epoxy[2] | 100 | None | — | None | — | 0.5 | 1 | 5 | 33.5 | 84 |

[1]Uvithane ® 893, Thiokol Corporation
[2]Diacrylate ester of a bisphenol A type epoxy resin (Celrad ® 3600, Celanese Chemical Co.)

The filled and unfilled TMPTA/TATHEIC resin systems of the present invention have thermal stability equivalent to or superior to the other resin systems.

EXAMPLE 3

This example demonstrates grinding performance results of the coated abrasives of this invention.

A radiation curable resinous binder composition was prepared by mixing 50 g of TMPTA with 50 g of TATHEIC. Then 100 g of quartz (Imsil ® A-10) was blended with the resinous mixture until a homogeneous mix was obtained. The same composition was used for the make coat and size coat. The make coat composition was applied to a 3 in. by 132 in. standard single cotton belt abrasive backing using a knife coater to give a uniform make coat. Abrasive mineral (grade 50 aluminum oxide) was then applied over the make coat of the belts via electrostatic coating to give uniform surface coverage. An electrostatic coater useful for this step is manufactured by Peter Swabe Co., West Germany. The abrasive loaded coating was passed through a 250 Kev electrocurtain electron beam (Energy Sciences, Inc.) operating at 1–10 Mrad of radiation as indicated in Table III. The line speed and current were controlled to give uniform dose.

The size coat was applied over the layer of abrasive mineral using a roll coater. Curing was completed under the same conditions as were used to cure the make coat. Several combinations of make coat and size coat were prepared according to this procedure. The samples thus prepared are summarized in Table III.

TABLE III

| Sample | Backing | Weight (g) Make coat | Mineral | Size coat | Radiation dosage (Mrad) Make coat[1] | Size coat[2] |
|---|---|---|---|---|---|---|
| 17 | Cotton (Y weight) | 41 | 154 | 92 | 5 | 10 |
| 18 | Cotton (Y weight) | 50 | 166 | 76 | 10 | 10 |
| 19 | Cotton (X weight) | 46 | 146 | 96 | 5 | 10 |
| 20 | Cotton (X weight) | 50 | 157 | 138 | 10 | 10 |

[1]Make coat was irradiated on the top as well as through the backing of the belt.
[2]Size coat was irradiated on the top only.

The samples were tested on a single belt robot grinder manufactured by Divine Brothers Co., Inc., Utica, N.Y. Each 3 inch by 132 inch belt was mounted upon a 55A durometer 14 inch diameter contact wheel which was driven at 6400 square feet per minute (SFPM) while a 1 inch by 10 inch reciprocating mild steel work piece (1018) was positioned parallel to the axis of the contact wheel. The work piece was forced against the belt using a constant load of 25 lbs. As used in this example and in those following, "initial cut wt." means weight of work piece ground away in the first minute of grinding, and "total cut wt." means weight of work piece ground away during the indicated grinding time. The results are shown in Table IV.

TABLE IV

| Sample | Initial cut wt. [1] (g) | Total cut wt. [2] (q) | Time (min) |
|---|---|---|---|
| 17 | 80 | 939 | 16.5 |
| 18 | 71 | 1039 | 21.5 |
| 19 | 88 | 1219 | 28 |
| 20 | 89 | 1294 | 28 |

[1]Weight of metal ground during first minute of grinding.
[2]Weight of metal ground for time indicated.
[3]Samples were ground using constant load of 25 pounds.

The resinous binders of the present invention performed successfully as radiation-cured coated abrasive binders.

EXAMPLE 4

This example, like Example 3, demonstrates grinding performance results of the coated abrasive of this invention, the major difference being that 220 grade abrasive mineral was used.

A radiation curable resinous binder composition was prepared by mixing 50 g of TMPTA with 50 g of TATHEIC until a homogenous mix was obtained. The same compostion was used for the make coat and size coat. The make coat composition was applied to a 3 in. by 132 in. standard single cotton belt abrasive backing using a knife coater to give a uniform make coat. The weight of the make coat was 10 g. Abrasive mineral (grade 220 aluminum oxide) was then applied over the make coat of the belts via electrostatic coating to give uniform surface coverage. The weight of the abrasive mineral was 61 g. The abrasive loaded coating was passed through a 250 Kev Electrocurtain® electron beam (Energy Sciences, Inc.) operating at 10 Mrad of radiation as indicated in Table III. The line speed and current were controlled to give uniform dose.

The sample, which was designated Sample 21, was coated by means of a two-roll coater with a size coat of an amount just sufficient to cover the abrasive mineral. Curing was completed using electron beam radiation (10 Mrad).

The sample was tested as in Example 3, the only difference being that the load of the work piece against the belt was 10 lbs. The initial cut weight (1 min.) was 25 g; the total cut weight (20 min.) was 279 g. A control employing phenolic resin had an initial cut weight of 12 g and a total cut weight of 212 g. The coated abrasives of the present invention was superior in grinding performance to a coated abrasive employing a phenolic binder.

EXAMPLE 5

This example demonstrates that an optional thermal cure can be used to insure cure of any resinous material not exposed to radiation on account of shielding by abrasive granules.

A thermal catalyst was added to the make coat composition to insure complete cure of any resinous material shaded by the abrasive mineral. The desired amount of catalyst was dissolved in an aliquot of solvent. The ratio of monomers, filler, and catalyst as shown in Table V were mixed until a homogeneous mixture was obtained.

TABLE V

| Sample | Monomer A | Amount | Monomer B | Amount | Filler | Amount |
|---|---|---|---|---|---|---|
| 22[1] | TMPTA | 50 | TATHEIC | 50 | Quartz | 100 |
| 23[1] | TMPTA | 50 | TATHEIC | 50 | Quartz | 100 |

[1]Benzoyl peroxide catalyst was used in Samples 22 and 23 at a level of 0.05 parts by weight.

The mixture, i.e. the make coat, was applied to the backing, X weight cotton in each case, by a knife coater. The abrasive mineral, aluminum oxide, was then electrostatically coated over the make coat to give a uniform surface coating. The resulting coat was then irradiated by passing under a 250 Kev electrocurtain electron-beam operating so as to give the desired dose of radiation. The samples were then thermally post cured in a forced air oven at 100° C. for 4 hours.

After the thermal post-cure the samples were coated by means of a two-roll coater with a size coat of an amount just sufficient to cover the abrasive mineral. The size coat of each sample was the same composition as that used for the make coat. Curing was completed using only electron-beam irradiation. Table VI shows coat weight and cure conditions for the abrasive samples.

TABLE VI

| Sample | Make coat wt (g) | Mineral wt (g) | Mineral grade | Dose make coat (Mrad) | Thermal cure (hrs) | Dose size coat (Mrad) |
|---|---|---|---|---|---|---|
| 22 | 47 | 139 | 50(AY) | 2 | 4 | 10 |
| 23 | 48.5 | 139.5 | 50(AY) | 2 | 4 | 10 |

The samples were tested on a single belt robot grinder of Example 3. The test procedure was the same as that used in Example 3.

The results of the robot grinding test are shown in Table VII. The controls were standard 3M® phenolic RBC-GG abrasive belts manufactured by the Minnesota Mining and Manufacturing Company.

TABLE VII

| Sample | Initial cut wt (g) | Total cut wt (g) | Time (min) |
|---|---|---|---|
| 22 | 95 | 1466 | 30 |
| 23 | 94 | 1577 | 30 |
| Control[1] | 90 | 1432 | 30 |

[1]Grade 50 (AY) aluminum oxide, phenolic resin binder.

The combination of a thermal cure with a radiation cure insures that the acrylate monomers will be polymerized and fully cured, even though they may be in a grit shadow during radiation exposure. Without a complete cure, the individual abrasive particles may be lost during grinding, thereby reducing the cutting performance.

EXAMPLE 6

This example demonstrates continuous coating techniques which are similar to actual manufacturing procedures for a radiation curable binder. The make and size resin coating compositions were prepared by methods described in Example 3, except that calcium carbonate was also used as a filler. A thermal catalyst was included in the composition as previously described in Example 5. Table VIII shows the ingredients and amounts thereof used for the make and size coat compositions. A pilot plant continuous coating line was set up to operate at 25 feet per minute web speed. The backing to be coated was treated in a continuous manner by knife coating the make coat, electrostatically coating the abrasive mineral, and then irradiation with an electron beam in an air atmosphere. The semi-finished web was given a thermal cure. Continuous treatment continued with roll coating a resin size coat on to the mineral side of the web and then irradiating with an electron beam in a nitrogen atmosphere.

TABLE VIII

| Coating Composition | Monomer A | Amount | Monomer B | Amount | Monomer C | Amount | Filler | Amount |
|---|---|---|---|---|---|---|---|---|
| A[3] | TMPTA | 25 | TATHEIC | 25 | — | — | Quartz | 50 |
| B[3] | TMPTA | 25 | TATHEIC | 25 | — | — | $CaCO_3$ | 50 |
| C | Acrylated-epoxy[1] | 30 | NVP | 10 | TMPTA | 10 | $CaCO_3$ | 50 |
| D | Acrylated-epoxy[2] | 30 | NVP | 10 | TMPTA | 10 | $CaCO_3$ | 50 |

[1]Celrad ® 3600, Celanese Chemical Co.
[2]Celrad ® 3500, Celanese Chemical Co.
[3]Compositions A and B also contained 0.02 parts by weight benzoyl peroxide catalyst.

Table IX shows which composition was used for the make coat and which was used for the size coat in each sample.

TABLE IX

| Sample | Mineral | Grade | Make resin | Size resin |
|---|---|---|---|---|
| 24 | $Al_2O_3$ | 50 (AY) | A | same as make |
| 25 | $Al_2O_3$ | 50 (AY) | B | same as make |
| 26 | $Al_2O_3$ | 80 (AY) | B | same as make |
| 27 | $Al_2O_3$ | 80 (AY) | C | D |
| 28 | $Al_2O_3$ | 100 (AY) | B | same as make |
| 29 | $Al_2O_3$ | 100 (AY) | B | same as make |

The make resin was knife coated onto the backing, X weight cotton in each case, at a 4 mil wet thickness. The abrasive mineral was then electro-statically coated over the make coat to give the desired coating weight for a given grade of mineral as shown in Table X. The make coat was irradiated at 225 Kev with a dose of 3 Mrad under ambient air. Samples 24–26 and 28–29 received thermal cure in an oven at 100° C. for 8 hours before being size coated.

The size coat was applied with a roll coater at a coating weight in accordance with Table X.

TABLE X

| Mineral grade | Mineral weight (g/sq. in.) | Size coat wt. (g/sq. in.) |
|---|---|---|
| 50 | 0.4 | 0.14 |
| 80 | 0.24 | 0.097 |
| 100 | 0.19 | 0.064 |

The size coat was cured at 225 Kev with a dose of 3 Mrad under a nitrogen blanket.

Performance testing was conducted with a robot grinder according to test conditions previously described in Example 3, with the exceptions that the load for grade 80 mineral was 15 lbs., and the load for grade 100 mineral was 15 lbs. The results are shown in Table XI.

TABLE XI

| Sample | Initial cut wt. (g) | Total cut wt. (g) | Time (min) | % Control |
|---|---|---|---|---|
| 24 | 80 | 1,248 | 30 | 92 |
| 25 | 82 | 1,341 | 30 | 99 |
| Control[1] (phenolic) | 70 | 1,361 | 30 | 100 |
| 26 | 41 | 843 | 30 | 100 |
| 27 | 38 | 628 | 30 | 75 |
| Control[2] (phenolic) | 40 | 843 | 30 | 100 |
| 28 | 33 | 590 | 30 | 116 |
| 29 | 35 | 659 | 30 | 130 |
| Control[3] (phenolic) | 30 | 507 | 30 | 100 |

[1]Grade 50 (AY) $Al_2O_3$ on 3M ® RBC-GG abrasive belt having phenolic binder.
[2]Grade 80 (AY) $Al_2O_3$ on 3M ® RBC-GG abrasive belt having phenolic binder.
[3]Grade 100 (AY) $Al_2O_3$ on 3M ® RBC-GG abrasive belt having phenolic binder.

The abrasive sheets of this invention exhibited grinding properties equivalent or superior to those of the phenolic controls and the prior art (sample 27).

EXAMPLE 7

This example demonstrates additional novel binder resin formulations. The radiation curable resinous compositions were prepared by mixing the monomers and fillers as shown in Table XII. A thermal catalyst was included in two of the resinous compositions. The make resin composition was coated onto the backing, X weight cotton in each case, by means of a knife coater to a 4 mil wet thickness. The abrasive mineral, $Al_2O_3$ (grade 100 (AY) in each case), was applied over the make coat by means of electrostatic coating. The mineral coated resin was electron beam cured at 240 Kev with a dose of 3 Mrad in air. This was followed by application by roll coater of size resin composition (0.064 g/sq. in.) and cure thereof at 240 Kev with a dose of 3 Mrad. Samples 30 and 32 each received a thermal post cure at 100° C. for 4 hours.

TABLE XII

| Sample | Monomer A | Amount | Monomer A | Amount | Filler | Amount |
|---|---|---|---|---|---|---|
| 30[1] | HMDI-T7 | 25 | TMPTA | 25 | $CaCO_3$ | 50 |
| 31 | HMDI-T7 | 25 | TMPTA | 25 | $CaCO_3$ | 50 |
| 32[1] | HMDI-T9 | 25 | TMPTA | 25 | $CaCO_3$ | 50 |
| 31 | HMDI-T9 | 25 | TMPTA | 25 | $CaCO_3$ | 50 |

[1]Benzoyl peroxide catalyst was used in Samples 30 and 32 at a level of 0.02 parts by weight.

The robot grinder was employed to measure performance of these samples as in Example 3 with a constant load of 15 lbs. The performance results are shown in Table XIII.

TABLE XIII

| Sample | Thermal post cure | Initial cut wt (g) | Total cut wt (g) | Time (min) |
|---|---|---|---|---|
| Control[1] (phenolic) | | 35 | 585 | 30 |
| 30 | Yes | 36 | 681 | 30 |
| 31 | No | 30 | 640 | 30 |
| 32 | Yes | 39 | 644 | 30 |
| 33 | No | 31 | 647 | 30 |

[1]Grade 100 (AY) $Al_2O_3$ on 3M ® RBC-GG abrasive belt having phenolic binder.

The abrasive sheet of this invention exhibited grinding properties equivalent to or superior to those of the phenolic control.

EXAMPLE 8

This example demonstrates the performance of the coated abrasive on fiber discs. The radiation curable coating composition was prepared according to the conditions for composition B of Example 6. The make coat composition was applied by paint brush to a 30 mil vulcanized rag pulp fiber disc (e.g. a 3M ® C disc.) having a diameter of 7 inches. The total weight of the make coat was 4 g. The abrasive mineral, 15 g Grade 50 Cubitron ®abrasive (see U.S. Pat. No. 4,314,827), was applied over the make coat by electrostatic coating. The coated sample was irradiated with electron beam at 250 Kev with a 5 Mrad dose in air.

The size coat composition was applied over the abrasive coat with a paint brush at a weight of 9 g. The size coat was cured with electron beam at 250 Kev with a 5 Mrad dose in nitrogen. A subsequent thermal post cure (8 hours at 100° C.) was then conducted. Performance testing was conducted by a 3M ® standard disc sanding test which consisted of an edge and flat test. The edge test involved placing the work piece in proximity to the outer periphery of the disc at the prescribed angle at the prescribed load for the prescribed time. The flat test involved placing the work piece at a distance of about 1 inch inward from the outer periphery of the disc at the prescribed angle at the prescribed load for the prescribed time. The edge test was conducted at an angle of 18° under a constant load (2896 g) for 8 minutes while the flat was conducted at an angle of 7° under a constant load (2670 g) for 8 minutes. The work piece was mild steel. The results are shown in Table XIV.

TABLE XIV

| Sample | Total cut wt. (g) Edge | Flat |
|---|---|---|
| Control[1] | 48 | 61 |
| 34 | 66 | 65 |
| 35 | 68 | 59 |

[1]3M ® type C disk having a phenolic binder.

The abrasive sheets of this invention exhibited grinding performance equivalent to or superior to those of the phenolic control.

EXAMPLE 9

This example demonstrates abrasive construction usable under wet conditions made from a radiation curable resinous binder. The radiation curable resin used for the make and size coating compositions was prepared by stirring the ingredients with a mechanical mixer. The ingredients and amounts thereof are shown in Table XV.

TABLE XV

| Sample | Backing | Make Resin | Size Resin |
|---|---|---|---|
| 36 | A wt paper | 70% HMDI-T7, 30% N—BUMA | 70% TMDI-T2, 30% TMPTA |
| 37 | A wt paper | 70% HMDI-T7, 30% N—BUMA | 70% TMDI-T2, 30% TMPTA |
| 38 | A wt paper | 70% HMDI-T7, 30% N—BUMA | 70% TMDI-T4, 30% TEGDMA |
| 39 | A wt paper | 70% HMDI-T7, 30% N—BUMA | 70% TMDI-T4, 30% TEGDMA |
| 40 | A wt paper | 70% TMDI-T2, 30% TMPTD | 70% TMDI-T2, 30% TMPTA |
| 41 | 1.3 mil PET | 70% HMDI-T7, 30% N—BUMA | 70% TMDI-T2, 30% TMPTA |

The make coat composition was applied by a knife coater to give a coating thickness of 1 mil. Abrasive mineral, SiC, 220 grade, was applied over the make coat by electrostatic coating at a coating density of 0.081 g/sq. in. The coat was cured by irradiating with electron beam at 235 Kev with a 3 Mrad dose in an air environment.

The size coat composition was applied by means of a roll coater to give a coating weight of 0.029 g/sq. in. The coat was cured by irradiating with electron beam at 200 Kev with a 3 Mrad dose in a nitrogen environment.

The samples were tested using a modified Schieffer disc tester. Four-inch diameter discs were die cut and installed in a testing machine for evaluation of abrasiveness. The testing machine consisted of a mechanically driven 4-inch diameter rotating steel backing plate upon which the abrasive coated samples were applied. The rotating abrasive samples were forced with a constant load of 10 pounds against a stationary surface of a polymethylmethacrylate (PMMA) disc. The test consisted of a 500 revolution cycle per test with a continuous wetting of the PMMA disc. Reported results, set forth in Table XVI consist of an average of four runs for each sample tested.

TABLE XVI

| Sample | Average cut wt. (g) | % Control |
|---|---|---|
| Control[1] | 2.02 | 100 |
| 36 | 1.83 | 91 |
| 37 | 1.95 | 97 |
| 38 | 1.88 | 93 |
| 39 | 1.88 | 93 |
| 40 | 1.89 | 94 |
| 41 | 1.87 | 93 |

[1]3M ® grade 220 WET or DRY ® Tri-M-ite ® paper A wt. W2.

EXAMPLE 10

This example compares the binder formulation of the present invention with that of binders described in the prior art. The make coat composition in each sample was knife coated onto the backing at a 4 mil wet thickness. The coating compositions is shown in Table XVII.

TABLE XVII

| Sample | Monomer A | Amount | Monomer B | Amount | Monomer C | Amount | Monomer D | Amount | Filler | Amount |
|---|---|---|---|---|---|---|---|---|---|---|
| 42 | Acrylated epoxy | 35 | NVP | 8 | IBOA | 10 | AA | 2 | $CaCO_3$ | 24 |

TABLE XVII-continued

| Sample | Monomer A | Amount | Monomer B | Amount | Monomer C | Amount | Monomer D | Amount | Filler | Amount |
|---|---|---|---|---|---|---|---|---|---|---|
| 43 | Acrylated urethane | 20 | NVP | 20 | TMPTA | 10 | — | — | $CaCO_3$ | 50 |
| 44 | TMPTA | 25 | TATHEIC | 25 | — | — | — | — | $CaCO_3$ | 50 |
| 45 | HMDI-T7 | 25 | TMPTA | 25 | — | — | — | — | $CaCO_3$ | 50 |

In each sample the backing was X weight cotton and the abrasive mineral was grade 100 (AY) aluminum oxide. The abrasive mineral was applied by electrostatic coating at a weight of 0.19 g/sq. in. The samples were irradiated at 240 Kev with 5 Mrad in air with the abrasive mineral side up.

The size coat composition in each sample was applied with a roll coater at a coating weight of 0.064 g/sq. in. The samples were cured by irradiation with electron beam at 240 Kev with a dose of 5 Mrad in a nitrogen environment. The size coat compositons for sample 42 contained 31 parts Celrad® 3600 acrylate epoxy, 9 parts IBOA, 6 parts TMPTA, 9 parts NVP, and 25 parts $CaCO_3$. The size coat compositions for samples 43, 44, and 45 were the same as those of the make coat compositions of these samples, as shown in Table XVII.

After the size coat had been cured, the samples were irradiated through the back side at 240 Kev with a 5 Mrad dose. Performance testing was done on single belt robot grinder as previously described in Example 3 with a load of 15 lbs. The results of the performance test are shown in Table XVIII.

TABLE XVIII

| Sample | Initial cut wt. (g) | Total cut wt. (g) | Time (min) |
|---|---|---|---|
| 42 | 39 | 513 | 30 |
| 43 | 36 | 580 | 30 |
| 44 | 35 | 659 | 30 |
| 45 | 36 | 681 | 30 |

Samples 44, and 45, the samples of the present invention, exhibit grinding properties superior to those of the prior art (samples 42 and 43).

Various modifications and alterations of this invention will become apparent to those skilled in the art wihout departing from the scope and spirit of this invention, and it should be understood that this invention is not to be unduly limited to the illustrative embodiments set forth herein.

What is claimed is:

1. A coated abrasive product comprising abrasive granules which are supported on and adherently bonded to at least one major surface of a backing sheet by a make coat of a first resinous binder material and a size coat of a second resinous binder material, at least one of said first resinous binder material or said second resinous binder material comprising a copolymer formed from a mixture comprising (1) at least one monomer selected from the group consisting of isocyanurate derivatives having at least one terminal or pendant acrylate group and isocyanate derivatives having at least one terminal or pendant acrylate group, and (2) at least one aliphatic or cycloaliphatic monomer having at least one terminal or pendant acrylate group.

2. The abrasive product of claim 1 wherein the ratio of isocyanurate or isocyanurate derivative monomer to the aliphatic or cycloaliphatic monomer having at least one terminal or pendant acrylate group ranges from about 1:3 to 3:1.

3. The abrasive product of claim 1 wherein the ratio of isocyanurate or isocyanate derivative monomer to the aliphatic or cycloaliphatic monomer having at least one terminal or pendant acrylate group ranges from about 1:1.5 to about 1.5:1.

4. The abrasive product of claim 1 wherein said isocyanurate derivative monomer is represented by the formula:

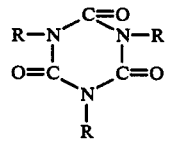

where each R can be the same or different and represents a group containing at least one terminal or pendant acrylate or methacrylate group.

5. The abrasive product of claim 4 where R is selected from the group consisting of

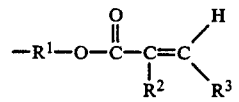

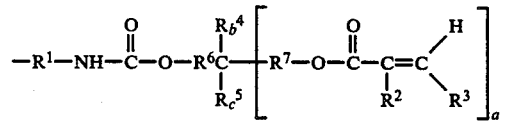

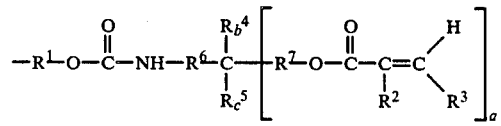

$R^1$ represents a divalent alkylene group,
$R^2$ represents —H or —$CH_3$,
$R^3$ represents —H or —$CH_3$,
$R^4$ represents —H, an alkyl group, or an arylalkyl group,
$R^5$ represents —H, an alkyl group, or an arylalkyl group,
$R^6$ represents a divalent alkylene group,
$R^7$ represents a covalent bond or a divalent alkylene group,
a represents an integer from 1 to 3, inclusive,
b represents 0 or 1,
c represents 0 or 1, and
a+b+c=3.

6. The abrasive product of claim 1 wherein said isocyanate derivative monomer is represented by the formula:

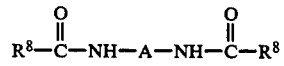

where

A represents a divalent alkylene group, each $R^8$ can be the same or different and represents

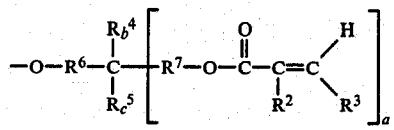

$R^2$ represents —H or —$CH_3$, $R^3$ represents —H or —$CH_3$, $R^4$ represents —H, an alkyl group, or an arylalkyl group, $R^5$ represents —H, an alkyl group, or an arylalkyl group, $R^6$ represents a divalent alkylene group, $R^7$ represents a covalent bond or a divalent alkylene group, a represents an integer from 1 to 3, inclusive, b represents 0 or 1, c represents 0 or 1, and a+b+c=3.

7. The abrasive product of claim 1 wherein said aliphatic or cycloaliphatic monomer having at least one acrylic group is represented by the formula:

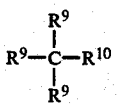

where each $R^9$ can be the same or different, and $R^9$ represents

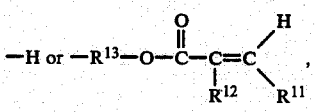

$R^{10}$ represents an alkyl group, $R^{11}$ represents —H or —$CH_3$, $R^{12}$ represents —H or —$CH_3$, and $R^{13}$ represents a covalent bond or a divalent alkylene group, at one of said $R^9$ not being —H.

8. The abrasive product of claim 1 wherein said abrasive granules are selected from the group consisting of flint, garnet, aluminum oxide, alumina:zirconia, diamond, and silicon carbide.

9. The abrasive product of claim 1 wherein said first resinous binder is said copolymer and said second resinous binder is selected from the group consisting of glue, varnish, epoxy resin, phenolic resin and polyurethane.

10. The abrasive product of claim 1 wherein said first resinous binder is selected from the group consisting of glue, varnish, epoxy resin, phenolic resin and polyurethane and said second resinous binder is said copolymer.

11. The abrasive product of claim 1 wherein said backing sheet is formed of paper, film, fiber, or woven cloth.

12. The abrasive product of claim 1 wherein said mixture further comprises a thermal curing catalyst.

13. Method of preparing the coated abrasive product of claim 1 comprising the steps of:

(1) providing a backing sheet, (2) applying said make coat to said backing sheet, (3) applying abrasive granules over said make coat, (4) at least partially curing said make coat, (5) applying said size coat over said make coat and said abrasive granules, and (6) completely curing said make and said size coat, provided that at least one of said curing steps is conducted by means of ultraviolet radiation.

14. The method of claim 13 wherein at least one of said curing steps is conducted by means of electromagnetic radiation.

15. The method of claim 14 wherein said electromagnetic radiation is ultraviolet radiation.

16. The method of claim 14 wherein said electromagnetic radiation is ionizing radiation.

17. The method of claim 20 wherein said ionizing radiation is electron beam radiation.

18. The method of claim 13 further including the step of post-curing said cured coated abrasive product by means of thermal energy.

19. A coated abrasive product comprising abrasive granules which are supported on and adherently bonded to at least one major surface of a backing sheet by a resinous binder material, said resinous binder material comprising a copolymer formed from a mixture comprising (1) at least one monomer selected from the group consisting of isocyanurate derivatives having at least one terminal or pendant acrylate group and isocyanate derivatives having at least one terminal or pendant acrylate group, and (2) at least one aliphatic or cycloaliphatic monomer having at least one terminal or pendant acrylate group.

20. Method of preparing the coated abrasive product of claim 12 comprising the steps of:

(1) providing a backing sheet, (2) applying said make coat to said backing sheet, (3) applying abrasive granules over said make coat, (4) at least partially curing said make coat, (5) applying said size coat over said make coat and said abrasive granules, and (6) completely curing said make and said size coat, provided that one of said curing steps is conducted by means of ionizing radiation and the other of said curing steps is conducted by means of thermal energy.

21. Method of preparing the coated abrasive product of claim 12 comprising the steps of:

(1) providing a backing sheet, (2) applying said make coat to said backing sheet, (3) applying abrasive granules over said make coat, (4) at least partially curing said make coat, (5) applying said size coat over said make coat and said abrasive granules, and (6) completely curing said make and said size coat, provided that at least one of said curing steps is conducted by means of ultraviolet radiation.

22. Method of preparing the coated abrasive product of claim 1 comprising the steps of:

(1) providing a backing sheet, (2) applying said make coat to said backing sheet, (3) applying abrasive granules over said make coat, (4) at least partially curing said make coat, (5) applying said size coat over said make coat and said abrasive granules, and (6) completely curing said make and said size coat, provided that at least one of said curing steps is conducted by means of ionizing radiation followed by a post-cure with thermal energy.

23. Method of preparing the coated abrasive produce of claim 12 comprising the steps of:

(1) providing a backing sheet, (2) applying said make coat to said backing sheet, (3) applying abrasive granules over said make coat, (4) at least partially curing said make coat, (5) applying said size coat over said make coat and said abrasive granules, and (6) completely curing said make and said size coat, provided that at least one of said curing steps is conducted by means of ultraviolet radiation followed by a post-cure with thermal energy.

* * * * *